US011209760B1

(12) United States Patent
Fukushima et al.

(10) Patent No.: US 11,209,760 B1
(45) Date of Patent: Dec. 28, 2021

(54) THERMAL FIXING APPARATUS AND IMAGE FORMING APPARATUS

(71) Applicant: CANON KABUSHIKI KAISHA, Tokyo (JP)

(72) Inventors: Hirotaka Fukushima, Tochigi (JP); Yusuke Owaki, Tochigi (JP); Yoshiko Igarashi, Tochigi (JP); Hidetaka Nanao, Iwate (JP); Yasushi Hoshi, Iwate (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/336,592

(22) Filed: Jun. 2, 2021

(30) Foreign Application Priority Data

Jun. 9, 2020 (JP) ..... 2020-100377

(51) Int. Cl.
*G03G 15/20* (2006.01)

(52) U.S. Cl.
CPC ..... *G03G 15/2057* (2013.01); *G03G 15/206* (2013.01); *G03G 15/2064* (2013.01); *G03G 2215/2035* (2013.01); *G03G 2215/2038* (2013.01)

(58) Field of Classification Search
CPC ..... G03G 15/2057; G03G 15/206; G03G 15/2064; G03G 2215/2035; G03G 2215/2038
See application file for complete search history.

(56) References Cited

U.S. PATENT DOCUMENTS

| | | | | |
|---|---|---|---|---|
| 9,274,470 | B2 | 3/2016 | Nakayama | |
| 2011/0020018 | A1* | 1/2011 | Takenaka | G03G 15/2053 399/33 |
| 2012/0195656 | A1* | 8/2012 | Saegusa | C08L 33/14 399/333 |
| 2015/0016853 | A1 | 1/2015 | Nakayama | |
| 2016/0154351 | A1* | 6/2016 | Takai | G03G 15/2057 399/333 |

FOREIGN PATENT DOCUMENTS

| | | | |
|---|---|---|---|
| EP | 0 632 344 | A2 | 1/1995 |
| JP | 7-44037 | A | 2/1995 |
| JP | 7-130456 | A | 5/1995 |
| JP | 2010-122450 | A | 6/2010 |
| JP | 2015-34980 | A | 2/2015 |

OTHER PUBLICATIONS

Fukushima et al., U.S. Appl. No. 17/226,292, filed Apr. 9, 2021.

* cited by examiner

*Primary Examiner* — Joseph S Wong
(74) *Attorney, Agent, or Firm* — Venable LLP

(57) ABSTRACT

A thermal fixing apparatus, including a rotatable first member; a heater heating the first member; a rotatable second member forming a nip portion with the first member; and a pressurizing member disposed inside the first member, and having a contact surface with an inner surface of the first member. The pressurizing member includes a surface layer constituting the contact surface, and the surface layer comprises a diamond-like carbon film containing a hydrogen atom (H), a carbon atom (C) and a silicon atom (Si). 100×(H)/((H)+(C)) is 5 or less. 100×(Si)/((Si)+(C)) is 1 to 20. Between the contact surface and an inner circumferential surface of the first member, an oil film containing a fluorinated oil and a silicone oil is present.

7 Claims, 6 Drawing Sheets

THERMAL FIXING APPARATUS AND IMAGE FORMING APPARATUS

BACKGROUND

The present disclosure relates to a thermal fixing apparatus and an image forming apparatus including thermal fixing apparatus.

DESCRIPTION OF THE RELATED ART

Diamond-like carbon (hereinafter, also referred to as "DLC") is used as a surface coating material for a sliding member because of its high friction wear properties. To stabilize the sliding properties, a lubricant is applied to its sliding surface.

Japanese Patent Application Laid-Open No. 2015-34980 discloses a fixing apparatus including a rotatable first member heated by a heat source, a rotatable second member which forms a nip portion with the first member such that a recording material can be sandwiched therebetween, and a pressurizing member which is disposed inside the first member, has a contact surface with respect to an inner surface of the first member, and presses the first member against the second member, in which a surface layer forming the contact surface of the pressurizing member with respect to the inner surface of the first member is a specific diamond-like carbon film. This patent literature also discloses application of a greasy heat-resistant lubricant containing fluorine-based fine particles and a fluorine-based oil between the inner surface of the first member (fixing belt) and the surface layer.

However, there is a demand for a further enhancement in durability of thermal fixing apparatus included in electrophotographic image forming apparatuses.

SUMMARY

At least one aspect of the present disclosure is directed to providing a fixing apparatus having further enhanced durability. Another aspect of the present disclosure is directed to providing an electrophotographic image forming apparatus which can stably form high-quality electrophotographic images.

According to at least one aspect of the present disclosure, there is provided a thermal fixing apparatus, comprising: a first member which is rotatable; a heater which heats the first member; a second member which is rotatable, and forms a nip portion with the first member such that a recording material can be sandwiched therebetween; and a pressurizing member which is disposed inside the first member, has a contact surface with an inner surface of the first member, and presses the first member against the second member, wherein the pressurizing member includes a surface layer constituting the contact surface, the surface layer comprises a diamond-like carbon film, the diamond-like carbon film contains a hydrogen atom, a carbon atom, and a silicon atom, the proportion of the number of the hydrogen atom (H) to the sum of the number of the hydrogen atom (H) and the number of the carbon atom (C) ($100\times(H)/((H)+(C))$) in the diamond-like carbon film is 5 or less, the proportion of the number of the silicon atom (Si) to the sum of the number of the carbon atom (C) and the number of the silicon atom (Si) ($100\times(Si)/((Si)+(C))$) in the diamond-like carbon film is 1 or more and 20 or less, and wherein an oil film containing a fluorinated oil and a silicone oil is present between the contact surface and an inner circumferential surface of the first member. According to further aspect of the present disclosure, there is provided an image forming apparatus including a thermal fixing apparatus which heats a toner image on a recording material to fix the toner image onto the recording material, wherein the thermal fixing apparatus is the thermal fixing apparatus described above.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

A preferred embodiment according to the present disclosure will now be specifically described with reference to the drawings. It should be noted that the present disclosure is not limited only to the following embodiment, and a variety of modifications can be made and implemented without departing from the scope of technical ideas of the present disclosure.

The thermal fixing apparatus according to one aspect of the present disclosure includes a rotatable first member, a heater which heats the first member, a rotatable second member which forms a nip portion with the first member such that a recording material can be sandwiched therebetween, and a pressurizing member which is disposed inside of the first member, has a contact surface with an inner surface of the first member, and presses the first member against the second member.

The pressurizing member includes a surface layer forming the contact surface with the inner surface of the first member. The surface layer includes a diamond-like carbon film.

The diamond-like carbon film contains a hydrogen atom, a carbon atom, and a silicon atom. The proportion of the number of the hydrogen atom (H) to the sum of the number of the hydrogen atom (H) and the number of the carbon atom (C) ($100\times(H)/((H)+(C))$) in the diamond-like carbon film is 5 or less. The proportion of the number of the silicon atom (Si) to the sum of the number of the carbon atom (C) and the number of the silicon atom (Si) ($100\times(Si)/((Si)+(C))$) in the diamond-like carbon film is 1 or more and 20 or less. Furthermore, an oil film containing a fluorinated oil and a silicone oil is present between the contact surface and the inner circumferential surface of the first member.

It is considered that the DLC film containing silicon (hereinafter, also referred to as "Si-DLC") has a silanol group on its surface because the DLC film contains silicon. It is considered that the presence of the silanol group increases the affinity with the oil film containing a silicone oil.

It is also considered that higher lubrication is demonstrated by the presence of an oil film containing both the silicone oil and the fluorinated oil on the surface of the Si-DLC film.

Figure 5:
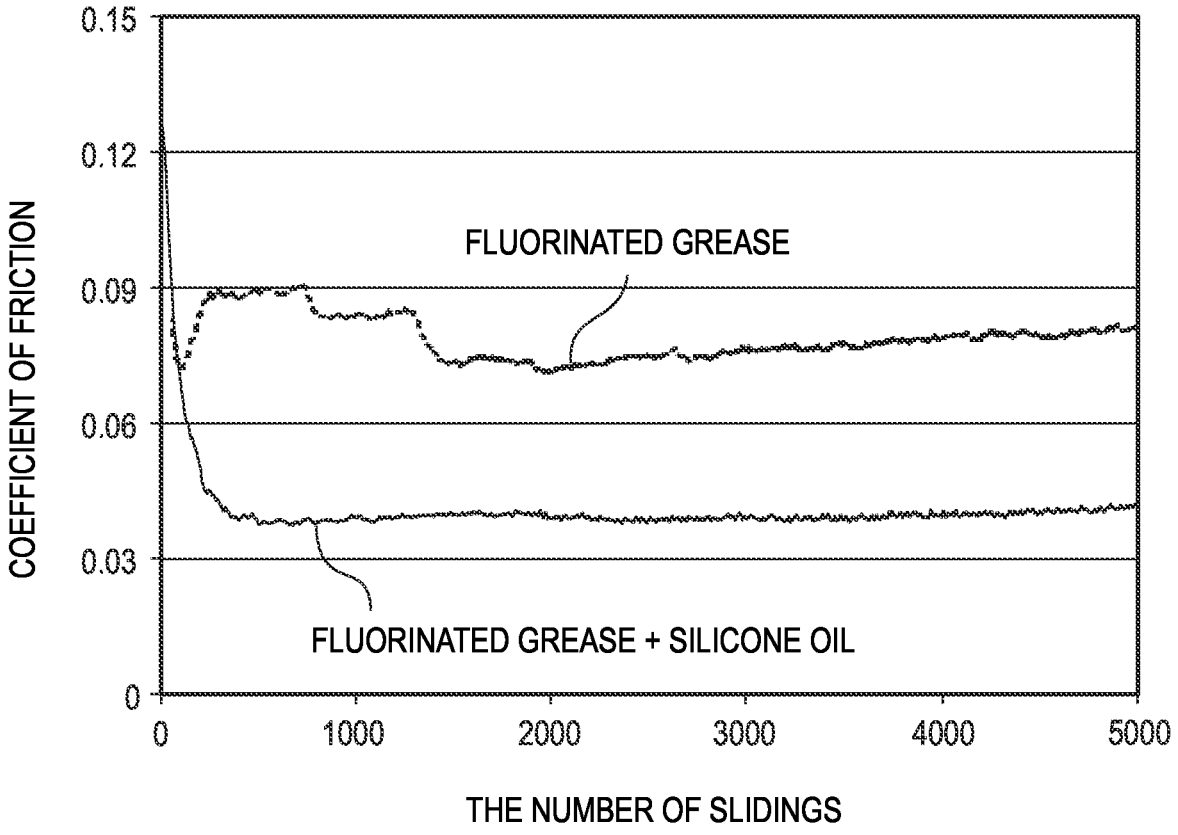
FIG. 5 shows the results of measurement of the coefficient of friction obtained from a pin plate test performed on the DLC according to the present disclosure.

FIG. 5 shows the results of measurement of the coefficient of friction of the Si-DLC film according to the present disclosure by a pin plate test using a friction wear tester (trade name: FPR2100, available from RHESCA Co., LTD.). It shows a result of the case where a lubricant containing a fluorinated grease and a silicone oil is used and a result of the case where only the fluorinated grease is used.

The Si-DLC film is placed on a surface of a ceramic plate. Using a pin with a distal end made of polyimide (trade name: VESPEL, available from E. I. du Pont de Nemours and Company) having a diameter of 5 mm, the pin and the DLC film were slid by the plate reciprocally moved at 32 mm/sec under a load of 100 g at an environmental temperature of 200° C. The results show that a lubricant containing the fluorinated grease and the silicone oil has a lower coefficient of friction.

Although the mechanism of action by which use of the lubricant containing the silicone oil and the fluorinated oil (fluorinated grease) results in such an effect of improving lubrication is not clarified, it is considered that since the silicone oil and the fluorinated oil have less affinity each other, the oils are mutual lubricate each other, and therefore, the sliding resistance may be reduced.

Use of the sliding member according to the present disclosure as the pressurizing member in the fixing apparatus can prolong the life of the fixing apparatus. In other words, according to the present disclosure, the durability life of the image forming apparatus can be increased by use of a thermal fixing apparatus having a durability life prolonged by a pressurizing member having lubrication enhanced by the Si-DLC film, the fluorinated oil, and the silicone oil.

Figure 1:
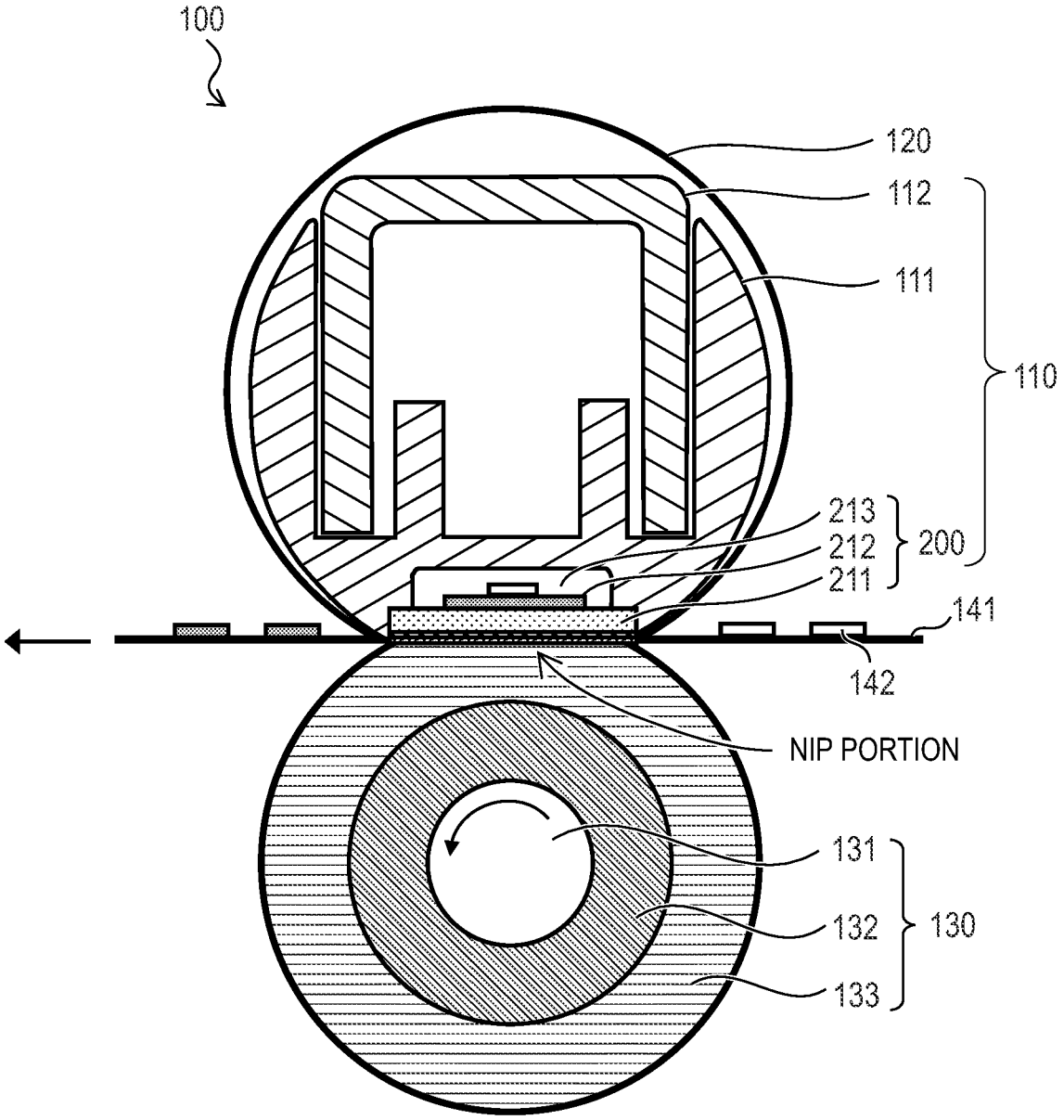
FIG. 1 is a schematic cross-sectional view illustrating one example of a thermal fixing apparatus according to one aspect according to the present disclosure.

FIG. 1 is a schematic cross-sectional view of one example of a pressurizing member according to the present disclosure and a thermal fixing apparatus including the pressurizing member. The thermal fixing apparatus illustrated in FIG. 1 includes a first member, a second member, and a pressurizing member which presses the first member and slides with the first member.

A fixing belt 120 as the first member has a sleeve shape and is rotatable. The sleeve shape indicates a shape of an endless band. A pressurizing roller 130 as the second member forms a nip portion with the fixing belt 120 such that a recording material 141 can be sandwiched therebetween, and is rotatable. A heater 200, which also serves as the pressurizing member, is disposed on an inner circumferential surface of the fixing belt 120 at the nip portion. The heater 200 is brought into contact with the inner circumferential surface of the fixing belt 120 to press the fixing belt. As a result of rotation of the fixing belt 120, a sliding surface is formed by the inner circumferential surface of the fixing belt 120 and the surface of the heater base 211.

The fixing belt 120 includes a stainless steel base having a sleeve shape, a silicone rubber layer disposed on the outer circumferential surface of the base, and a perfluoroalkoxyalkane resin-containing layer (PFA layer) disposed on the silicone rubber layer. The fixing belt 120 may include a resin film which forms the inner circumferential surface. The resin film which forms the inner circumferential surface preferably contains polyimide. The fixing belt 120 can have any size without any particular limitation. For example, the diameter is about 30 mm. In the fixing belt 120 having a diameter of about 30 mm, the stainless steel base, the silicone rubber layer, the PFA layer, and the polyimide film have thicknesses of, for example, about 600 μm, about 300 μm, about 20 μm, and about 1 to 20 μm, respectively.

Pressurizing roller 130 includes a stainless steel core 131, a silicone layer 132 disposed on the outer circumferential surface thereof, and a PFA layer 133. The pressurizing roller 130 can have any size. For example, the diameter is about 30 mm. In the pressurizing roller 130 having a diameter of about 30 mm, the silicone layer 132 and the PFA layer 133 have thicknesses of, for example, about 3 mm and about 40 μm, respectively.

Figure 2:
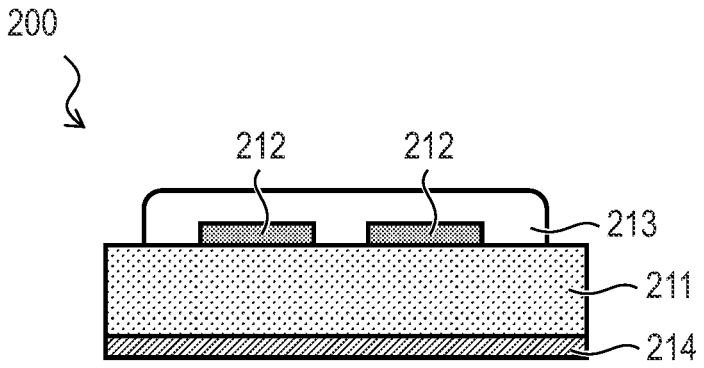
FIG. 2 is a cross-sectional view of a heater included in thermal fixing apparatus according to one aspect according to the present disclosure.

FIG. 2 illustrates a schematic cross-sectional view of one example of the heater 200. The heater 200 includes a heater base 211, a resistance heating element 212, and a thermistor (not illustrated) as a temperature sensor. The heater base 211 has a shape of a flat platy stripe having a size of about 400 mm×8 mm where the longitudinal direction thereof is defined as the direction intersecting perpendicular to the conveying direction (the arrow direction in FIG. 1) of the recording material 141. Although any material can be used as a material for the heater base 211, the material should be an insulating material because the resistance heating element 212 is formed. The material is preferably aluminum nitride. The material for the heater base 211 may have high thermal conductivity so that heat from resistance heating element 212 is readily conducted to the fixing belt 120. For this reason, aluminum oxide or silicon nitride can be used besides aluminum nitride. The resistance heating element 212 is subjected to insulating coating with a glass layer 213.

The surface of the heater base 211 sliding with the inner circumferential surface of the fixing belt includes a coating of an Si-DLC film 214 having a thickness of 0.5 μm. In the number of hydrogen atoms (H), the number of silicon atoms (Si), and the number of carbon atoms (C) in the Si-DLC film, the value of the expression (100×(H)/((H)+(C))) is 5 or less and the value of the expression (100×(Si)/((Si)+(C))) is 1 or more and 20 or less. A lubricant oil containing a fluorinated oil and a silicone oil is applied onto the sliding surface.

It is known that hydrogen contained in the DLC film reduces the hardness thereof. For this reason, preferred is a substantially hydrogen-free DLC film excluding inevitable components in production or a gas adsorbed on the surface of the film. Specifically, the hydrogen content is desirably equal to or less than the error of measurement in analysis by an analyzer such as elastic recoil detection analysis (or ERDA) using ion beams. For this reason, in the DLC, the proportion of the number of hydrogen atoms (H) to the number of carbon atoms (C) expressed by the expression (100×(H)/((H)+(C))) is preferably 5 or less.

An intermediate layer for enhancing adhesion may be disposed between the heater base 211 and the Si-DLC film 214. The intermediate layer can be formed of Ti, Cr, Si, or C, or a mixture or compound thereof by a method such as physical vapor deposition or chemical vapor deposition.

As illustrated in FIG. 1, the heater 200 is supported by a heater holder 111 having a semi-arc tub-like cross-section and a reinforcing plate 112 having an inverted U-shaped cross-section. In other words, the heater holder 111 to which the heater 200 is fixed is provided with the reinforcing plate 112. The heater holder 111 is made of a liquid crystal polymer resin having high heat resistance. Hereinafter, the heater 200, the heater holder 111, and the reinforcing plate 112 are referred to as a heater unit 110.

Both ends of the core 131 of the pressurizing roller 130 are rotatably held by the frame of the apparatus (not illustrated) with bearings. The pressurizing roller 130 is driven to be rotated by a motor (not illustrated) at a predetermined rate in the arrow direction in FIG. 1 while pressure is being applied to the outer circumferential surface of the fixing belt 120.

In the heater unit 110, both ends of the reinforcing plate 112 are fixed to the frame of the apparatus (not illustrated). The fixing belt 120 is fitted onto the heater unit 110. The heater unit 110 is pressed against the inner circumferential surface of the fixing belt 120.

For this reason, the fixing belt 120 is rotated through the recording material 141 conveyed following the rotation of the pressurizing roller 130, so that the nip portion for sandwiching the recording material 141 is formed by the pressurizing roller 130, the fixing belt 120, and the heater 200. At this time, by electric conduction of the resistance heating element 212 of the heater 200 which slides with the inner circumferential surface of the fixing belt 120, the fixing belt 120 is heated in the sliding surface (contact surface) with the heater 200, and is adjusted to reach a predetermined temperature.

The recording material 141 sandwiched by the nip portion is conveyed in the arrow direction illustrated in FIG. 1 by rotations of the pressurizing roller 130 and the fixing belt 120. At this time, an unfixed toner 142 on the recording material 141 is heated by the heated fixing belt 120 as a heat source to be fixed onto the recording material 141.

It should be noted that the thermal fixing apparatus of a fixing belt-pressurizing roller type is not limited to the embodiment illustrated in FIG. 1. In the embodiment illustrated in FIG. 1, the heater 200 serving as a heating member is also used as the pressurizing member. In other words, the pressurizing member is constituted by the heating member. However, the pressurizing member and the heating member may be provided as separate members in the thermal fixing apparatus. In that case, the heater 200 is brought into contact with the inner circumferential surface of the fixing belt 120 at a position different from the position illustrated in FIG. 1 to heat the fixing belt 120. Further, in that case, as the pressurizing member, a laminate structured body including a base 211, an intermediate layer, and an Si-DLC film 214 in this order may be employed.

Needless to say, besides the embodiment above, the present disclosure can also be applied to a thermal fixing apparatus according to Japanese Patent Application Laid-Open No. 2010-122450 which heats the fixing belt by electromagnetic induction heating. Favorable sliding properties can be obtained by disposing the sliding member according to the present disclosure on the surface of the pressurizing apparatus which presses the fixing belt and slides with the fixing belt.

Figure 3:
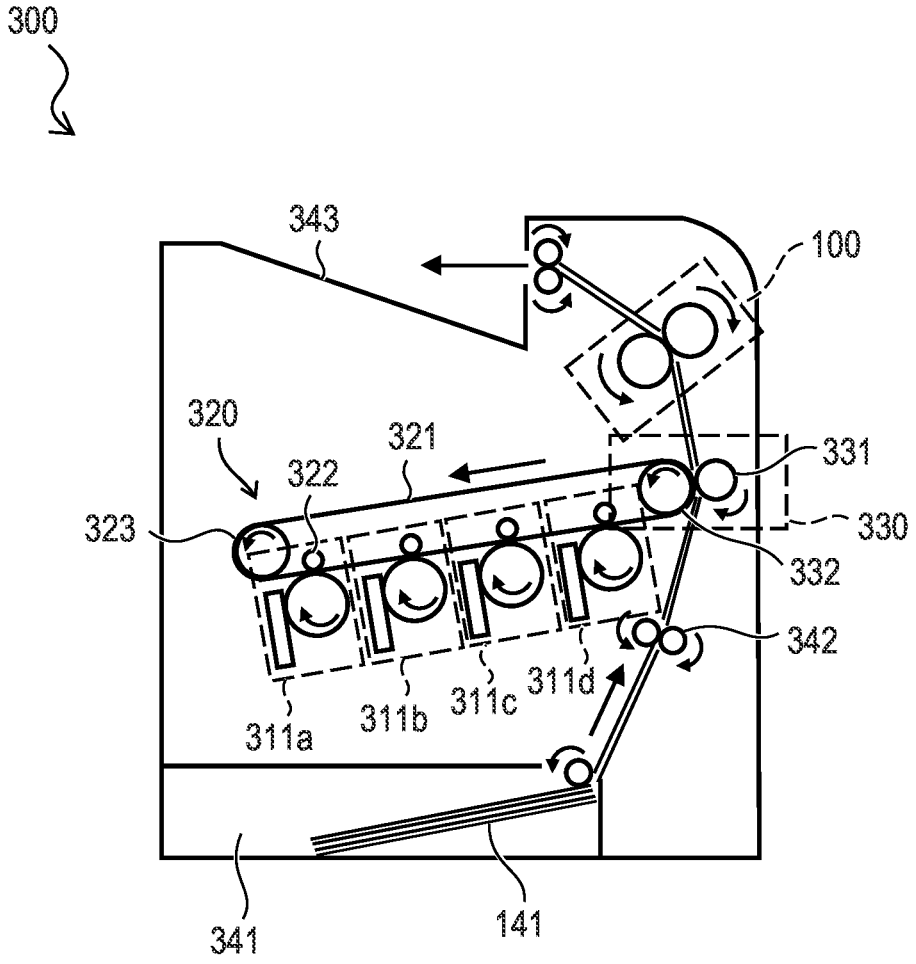
FIG. 3 is a cross-sectional view of an image forming apparatus according to one aspect according to the present disclosure.

FIG. 3 is a schematic cross-sectional view of an electrophotographic full-color printer of a laser exposure type, which is one example of an electrophotographic image forming apparatus including a thermal fixing apparatus 100 of the fixing belt-pressurizing roller type according to one embodiment according to the present disclosure. A printer 300 includes toner image forming apparatuses 311*a* to 311*d*, a primary transfer apparatus 320, a secondary transfer apparatus 330, a thermal fixing apparatus 100, a sheet feeder 341, a sheet feed roller 342, a sheet discharge tray 343, an external host apparatus (not illustrated), and a laser light source for exposure (not illustrated). In response to the input image information from an external host apparatus (not illustrated), a full-color image can be formed onto the recording material 141, and can be output.

Based on a color separation image signal input from an external host apparatus (not illustrated), toner images are formed on the surfaces of the drum-shaped electrophotographic photoreceptors, which are incorporated in yellow, magenta, cyan, and black toner image forming apparatuses 311*a* to 311*d*, by a laser exposure method using a laser light source for exposure (not illustrated). The electrophotographic image forming process by the laser exposure method is known, and thus the description thereof will be omitted.

The primary transfer apparatus 320 includes an endless flexible primary transfer belt 321, a primary transfer roller 322, and a tension roller 323.

The toner images of the four colors formed by the toner image forming apparatuses 311*a* to 311*d* are transferred and superimposed onto the primary transfer belt 321 by the transfer roller, the primary transfer belt 321 being extended by the tension roller 323 and a secondary transfer-facing roller 332 to be rotated around them. Thus, a non-fixed full-color toner image is formed on the primary transfer belt.

On the other hand, the recording material (paper sheet) 141 is conveyed at a predetermined sheet feeding timing by a sheet feed roller 342 from the sheet feeder 341 to a secondary transfer apparatus 330 including a secondary transfer roller 331 and the secondary transfer-facing roller 332. Here, the non-fixed full-color toner image (unfixed toner image) on the primary transfer belt 321 is transferred onto the recording material (paper sheet) 141.

Subsequently, the recording material (paper sheet) 141 is conveyed to the thermal fixing apparatus 100, and is heated by the thermal fixing apparatus 100. The non-fixed full-color toner image on the recording material (paper sheet) 141 is melted and mixed by heating, and is fixed onto the recording material (paper sheet) 141 as a fixed image.

Subsequently, the recording material (paper sheet) 141 having the fixed toner image is discharged to the sheet discharge tray 343.

The Si-DLC film 214 in FIG. 2 can be formed by physical vapor deposition such as arc deposition using silicon-containing graphite as a raw material or sputtering, or chemical vapor deposition using a hydrocarbon gas and silane gas as raw materials.

More preferred is physical vapor deposition using silicon-containing graphite as a raw material because the hydrogen content in the DLC film is readily reduced.

Figure 4:
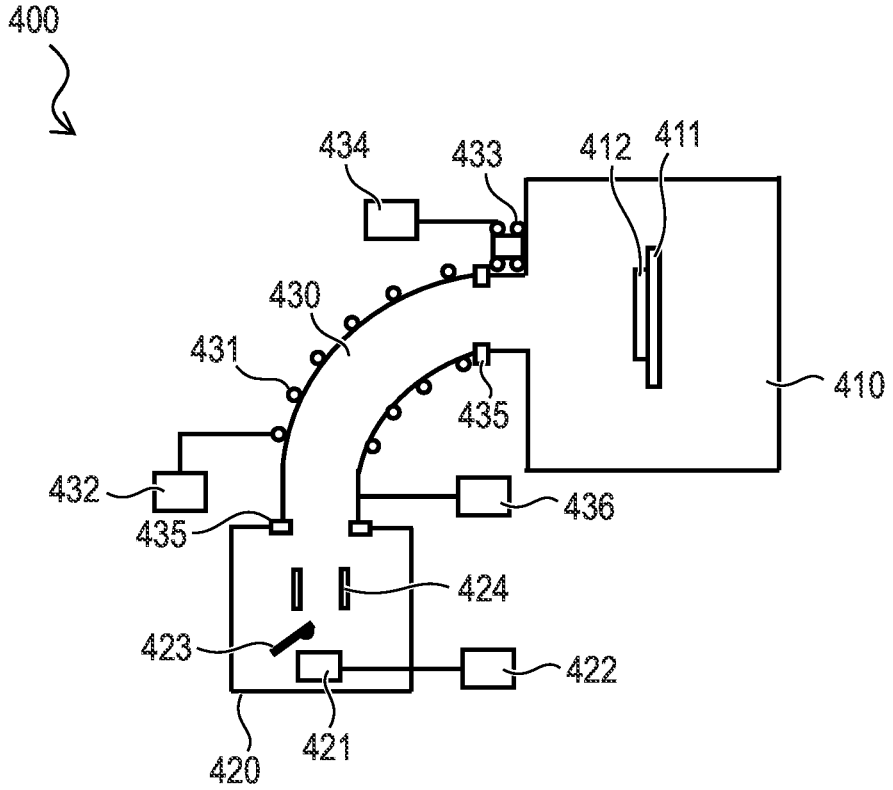
FIG. 4 is a diagram illustrating a film forming apparatus which forms a DLC film used in the thermal fixing apparatus according to one aspect according to the present disclosure.

As one example, an Si-DLC film forming apparatus 400 by arc deposition is illustrated in FIG. 4. The Si-DLC film forming apparatus 400 includes a film forming chamber 410 where a film forming treatment is performed, an arc plasma generating chamber 420 where arc plasma discharge is generated to evaporate a film material, and a duct filter 430 which transports the film material generated in the arc plasma generating chamber 420 to the film forming chamber 410.

The film forming chamber 410 is kept in vacuum by a vacuum pump (not illustrated). A base 412 for film formation is disposed in the film forming chamber 410 using a base holder 411. The base holder 411 can be rotated or moved during film formation as needed to form a film suitable for the shape of the base 412 for film formation.

The arc plasma generating chamber 420 is kept in vacuum by a vacuum pump (not illustrated) as the film forming chamber 410. A silicon-containing graphite target 421 is disposed in the arc plasma generating chamber 420. The silicon-containing graphite target 421 is connected to an arc discharge power supply 422 for generating arc discharge. A striker 423 for igniting arc discharge and an anode 424 for arc discharge are disposed above the silicon-containing graphite target 421.

The duct filter 430 includes a duct coil 431 for generating a magnetic field for deflecting the film material. The duct coil 431 is connected to a power supply 432 for the duct coil for electrically conducting the duct coil 431. The distal end of the duct filter 430 includes a scan coil 433 which generates a magnetic field for scanning charged particles of the film material. The scan coil 433 is connected to a power supply 434 for the scan coil. The duct filter 430 is insulated from the film forming chamber 410 and the arc plasma generating chamber 420 with an insulation member 435. The duct filter 430 is connected to a power supply 436 for the duct filter to enable control of the potential.

Electricity is applied from the arc discharge power supply 422 when the grounded striker 423 is brought into contact with or is detached from the silicon-containing graphite target 421. Thereby, arc plasma can be generated between the silicon-containing graphite target 421 and the anode 424. The arc plasma causes the film material to evaporate from the silicon-containing graphite target 421.

When the arc plasma causes the silicon-containing graphite target 421 to evaporate, fine particles of about several micrometers called droplets are generated. Such droplets are graphite rather than the DLC. While graphite has an advantage in that the coefficient of friction is reduced, it also has a disadvantage in that the film hardness is reduced. In addition, graphite forms protrusions on the film surface, resulting in an increase in surface roughness of the film. For this reason, the number of droplets is adjusted as needed.

The duct filter 430 is curved, which transports the film material generated in the arc plasma generating chamber 420 to the film forming chamber 410. The film material evaporated by the arc plasma, which are charged particles, are transported along the axis of the duct filter 430 to the film forming chamber 410 by the magnetic field formed inside the duct filter 430 by the duct coil 431 and the power supply 432 for the duct coil. In contrast, the droplets are often neutral. For this reason, the droplets travel straight without being deflected by the magnetic field formed inside the duct filter 430, to collide the curved portion of the duct filter 430. Thus, the amount of the droplets to be transported to the film forming chamber 410 is reduced and adjusted.

The film material is generated in the arc plasma generating chamber 420, and is transported through the duct filter 430 to the film forming chamber 410. Thereafter, the film material collides to the base 412 for film formation to be deposited thereon.

The amount of the film material to be transported and the amount of the droplets are adjusted by controlling the potential by the power supply 436 for the duct filter connected to the duct filter 430.

The oil film present between the contact surface of the pressurizing member and the inner circumferential surface of the first member in the thermal fixing apparatus according to the present disclosure contains a fluorinated oil and a silicone oil. The oil film may further contain a thickening agent such as PTFE particles. PTFE is particulate, and the primary average particle size is a value measured with an electron microscope, such as 0.1 to 1.0 μm.

Such an oil film is formed of a lubricant prepared by mixing a silicone oil with a fluorinated grease containing a fluorinated oil and a thickening agent, for example.

If the oil film contains PTFE, the amount of PTFE compounded is preferably adjusted in the range of 10 to 100 parts by mass, particularly 20 to 80 parts by mass based on 100 parts by mass of the fluorinated oil.

For example, perfluoropolyether (PFPE) can be suitably used as the fluorinated oil. PFPE is a polymer having the repeating unit of perfluoroalkylene ether. Specific examples of perfluoroalkylene ether include perfluoromethyl ether, perfluoroethyl ether, perfluoropropyl ether, and perfluoroisopropyl ether.

Commercial products of PFPE can be used. Examples of the commercial products include, but not limited to, PFPE represented by the structural formula (1) (such as Demnum S-200 and Demnum S-65 (trade names), available from DAIKIN INDUSTRIES, LTD.), PFPE represented by the structural formula (2) (such as Krytox GPL-107, Krytox GPL-106, and Krytox GPL-105 (trade names), available from The Chemours Company), PFPE represented by the structural formula (3) (such as Fomblin M60 and Fomblin Z25 (trade names), available from Solvay Specialty Polymers Inc.), and PFPE represented by the structural formula (4) (such as Fomblin Y45 and Fomblin Y25 (trade names), available from Solvay Specialty Polymers Inc.).

Formula (1)

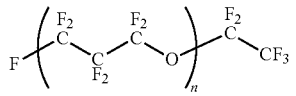

where n is a positive number in the range of numeric values satisfying a requirement that the kinematic viscosity at 40° C. is in the range of 10 to 300 $mm^2/s$, Formula (2)

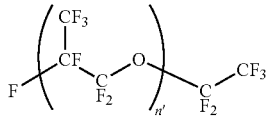

where n' is a positive number in the range of numeric values satisfying a requirement that the kinematic viscosity at 40° C. is in the range of 5 to 1200 $mm^2/s$, Formula (3)

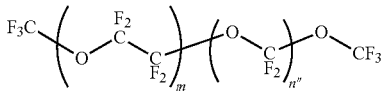

where n" and m are each a positive number in the range of numeric values satisfying a requirement that the value min" is 0.5 or more and 2 or less and the value of (n"+m) is a numeric value satisfying a requirement that the kinematic viscosity at 40° C. is 10 to 900 $mm^2/s$, and Formula (4)

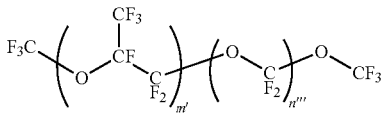

where n''' and m' are each a positive number, the value of m'/n''' is 20 or more and 1000 or less, and the value of (n'''+m') is a numeric value satisfying a requirement that the kinematic viscosity at 40° C. is in the range of 10 to 700 $mm^2/s$.

Since used in the thermal fixing apparatus, the silicone oil is preferably a silicone oil having high heat resistance. Specifically, for example, dimethylsilicone oil for high temperature (such as "KF965" (trade name; available from Shin-Etsu Chemical Co., Ltd.)) or methylphenylsilicone oil for high temperature (such as "KF-54" (trade name, available from Shin-Etsu Chemical Co., Ltd.)) can be used.

The content of the silicone oil in the lubricant forming the oil film is preferably 1 to 10% by mass, particularly 3 to 7% by mass based on the fluorinated grease.

According to one aspect according to the present disclosure, a fixing apparatus having higher durability can be provided. According to another aspect according to the present disclosure, an electrophotographic image forming apparatus which can stably form high-quality electrophotographic images can be provided.

EXAMPLES

Examples according to the embodiments will now be described.

Example 1

In Example 1, the Si-DLC sliding film 214 in the thermal fixing apparatus 100 according to one aspect according to the present disclosure was prepared so that the number of hydrogen atoms (H), the number of silicon atoms (Si), and the number of carbon atoms (C) satisfied the requirement that the value of (100×(H)/((H)+(C))) was 0.5 and the value of (100×(Si)/((Si)+(C))) was 2.

The Si-DLC sliding film in Example 1 was formed on a base surface at an arc discharge current of 50 A in the apparatus illustrated in FIG. 4, using a graphite target having a density of 1.7 $g/cm^3$ and an Si content of 2 atomic %.

Figure 6:
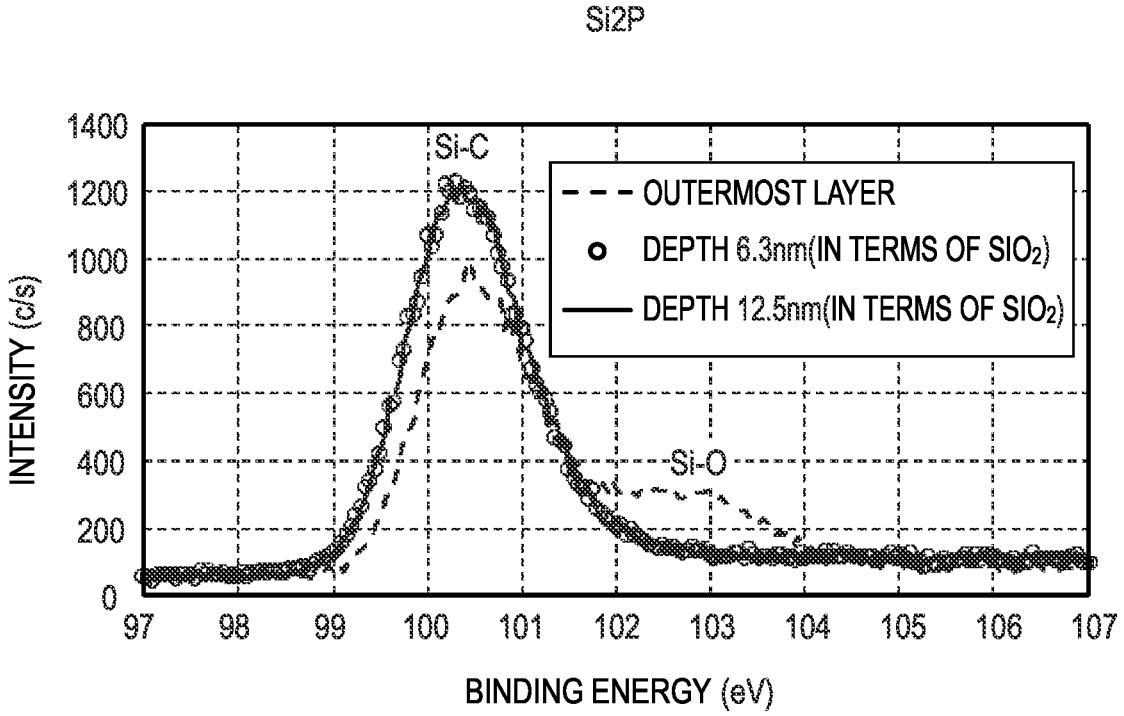
FIG. 6 is a spectrum of the 2p orbital of Si in the DLC film where the spectrum is obtained by XPS analysis.

FIG. 6 illustrates the spectrum of the 2p orbital of the silicon atom Si in the DLC film, the spectrum being obtained by X-ray photoemission spectroscopy (X-ray Photoelectron Spectroscopy or XPS) using AlKα as the light source of a scanning X-ray photoelectron spectroscope (trade name: Quantera SXM, available from ULVAC-PHI, Inc.). Si—C bonds and Si—O bonds were observed on the outermost surface (sliding surface) of the DLC film while Si—C bonds were observed inside the film. The Si content (100×(Si)/((Si)+(C))) obtained by XPS analysis was 2. The hydrogen content (100×(H)/((H)+(C))) inside the film was 0.5 from ERDA analysis.

Using the Si-DLC sliding film 214 prepared above, a pressurizing member including the Si-DLC sliding film 214 as a surface layer was prepared, and a thermal fixing apparatus illustrated in FIG. 1 was prepared.

A fluorinated grease and a silicone oil were used as lubricants as shown in Table 1. The fluorinated grease is a mixture of a perfluoropolyether (PFPE) oil and poly(tetrafluoroethylene) (PTFE) as a thickening agent. The content of PTFE relative to PFPE was adjusted in the range of 10 to 100 parts by mass based on 100 parts by mass of PFPE. The content of the silicone oil relative to the fluorinated grease was adjusted in the range of 3 to 6% by mass.

Example 2

In Example 2, the Si-DLC sliding film in Example 1 was replaced by an Si-DLC sliding film having a value of (100×(H)/((H)+(C))) of 0.5 or less and the value of (100×(Si)/((Si)+(C))) of 3. Except for that, a pressurizing member was prepared in the same manner as in Example 1, and a thermal fixing apparatus illustrated in FIG. 1 was prepared. The same lubricant as that in Example 1 was used.

Example 3

In Example 3, the Si-DLC sliding film in Example 1 was replaced by an Si-DLC sliding film having a value of (100×(H)/((H)+(C))) of 0.5 or less and a value of (100×(Si)/((Si)+(C))) of 11. Except for that, a pressurizing member was prepared in the same manner as in Example 1, and a thermal fixing apparatus illustrated in FIG. 1 was prepared. The same lubricant as that in Example 1 was used.

Example 4

In Example 4, the Si-DLC sliding film in Example 1 was replaced by an Si-DLC film having a value of (100×(H)/((H)+(C))) of 0.5 or less and a value of (100×(Si)/((Si)+(C))) of 19. Except for that, a pressurizing member was prepared in the same manner as in Example 1, and a thermal fixing apparatus illustrated in FIG. 1 was prepared. The same lubricant as that in Example 1 was used.

Example 5

In Example 5, the Si-DLC sliding film in Example 1 was replaced by an Si-DLC having a value of (100×(H)/((H)+(C))) of 0.5 or less and a value of (100×(Si)/((Si)+(C))) of 1. Except for that, a pressurizing member was prepared in the same manner as in Example 1, and a thermal fixing apparatus illustrated in FIG. 1 was prepared. The same lubricant as that in Example 1 was used.

Comparative Example 1

In Comparative Example 1, the Si-DLC sliding film in Example 1 was replaced by an Si-DLC film having a value of (100×(H)/((H)+(C))) of 0.5 or less and a value of (100×(Si)/((Si)+(C))) of 50. Except for that, a pressurizing member was prepared in the same manner as in Example 1, and a thermal fixing apparatus illustrated in FIG. 1 was prepared. The same lubricant as that in Example 1 was used.

Comparative Example 2

In Comparative Example 2, the Si-DLC sliding film in Example 1 was replaced by a DLC film having a value of (100×(H)/((H)+(C))) of 0.5 or less and a value of (100×(Si)/((Si)+(C))) of 0. Except for that, a pressurizing member was prepared in the same manner as in Example 1, and a thermal fixing apparatus illustrated in FIG. 1 was prepared. The same lubricant as that in Example 1 was used.

Comparative Example 3

In Comparative Example 3, the Si-DLC sliding film in Example 1 was replaced by an Si-DLC film having a value of (100×(H)/((H)+(C))) of 0.5 or less and a value of (100×(Si)/((Si)+(C))) of 3. The lubricant used was the fluorinated grease used in Example 1. Except for these, a pressurizing member was prepared in the same manner as in Example 1, and a thermal fixing apparatus illustrated in FIG. 1 was prepared.

<Evaluation>

Table 1 shows the results of evaluation of the durability life of the thermal fixing apparatuses in Examples 1 to 5 and Comparative Examples 1 to 3. A reduction in sliding properties causes abnormalities such as abnormal sounds due to stick-slip (adhesion) or breakage of the fixed film. The time until such abnormalities occurred was evaluated.

For the test conditions, the temperature of the heater base was 200° C., and the pressure applied to the sliding surface of the heater base was 0.2 MPa. The sheet feeding rate (the rate of the fixed film sliding with the surface of the heater base) was 350 mm/sec, and was 82 mm/sec in examination of the abnormal sounds due to stick-slip. The former setting is for the purpose of sliding at a high speed to shorten the time needed for evaluation, and the latter setting in the examination of the abnormal sounds due to stick-slip is for the purpose of sliding at a low speed at which stick-slip readily occurs. In Examples 1 to 4, the examination of the abnormal sounds was performed at 200 hours from the start of the durability test or later.

In Examples 1 to 5 and Comparative Examples 1 to 3, abnormal sounds were generated due to stick-slip although the fixed film was not broken. While abnormal sounds were generated within 200 hours from the start of the test in Comparative Examples 1 to 3, abnormal sounds were generated at 200 hours from the start of the test or later in Examples 1 to 4. Specifically, abnormal sounds were generated after 400 hours in Example 1, after 344 hours in Example 2, after 296 hours in Example 3, and after 265 hours in Example 4 from the start of the test. In all of Examples 1 to 4, the durability life was increased by dozens of percentage relative to that of Comparative Example.

[Table 1]

TABLE 1

| | Silicon atom in DLC film | Lubricant | Durability time (reference time for determination: 200 hours) |
|---|---|---|---|
| Example 1 | 2% | Fluorinated grease and silicone oil | OK (420 hours) |
| Example 2 | 3% | Fluorinated grease and silicone oil | OK (450 hours) |
| Example 3 | 11% | Fluorinated grease and silicone oil | OK (296 hours) |
| Example 4 | 19% | Fluorinated grease and silicone oil | OK (265 hours) |
| Example 5 | 1% | Fluorinated grease and silicone oil | OK (249 hours) |
| Comparative Example 1 | 50% | Fluorinated grease and silicone oil | NG |
| Comparative Example 2 | 0% | Fluorinated grease and silicone oil | NG |
| Comparative Example 3 | 3% | Fluorinated grease | NG |

* Fluorinated grease: "MOLYKOTE HP300" (trade name, available from DuPont Toray Specialty Materials K.K.)
* Silicone oil: "KF965" (trade name, available from Shin-Etsu Chemical Co., Ltd.)

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-100377, filed Jun. 9, 2020, which is hereby incorporated by reference herein in its entirety.

What is claimed is:

1. A thermal fixing apparatus, comprising:

a first member which is rotatable;

a heater which heats the first member;

a second member which is rotatable, and forms a nip portion with the first member such that a recording material can be sandwiched therebetween; and a pressurizing member which is disposed inside the first member, has a contact surface with an inner surface of the first member, and presses the first member against the second member, wherein the pressurizing member includes a surface layer constituting the contact surface, wherein the surface layer comprises a diamond-like carbon film, wherein the diamond-like carbon film contains a hydrogen atom, a carbon atom, and a silicon atom, wherein a proportion of a number of hydrogen atoms (H) to a sum of the number of the hydrogen atoms (H) and a number of carbon atoms (C) (100×(H)/((H)+(C))) in the diamond-like carbon film is 5 or less, wherein a proportion of a number of silicon atoms (Si) to a sum of the number of the carbon atoms (C) and the number of the silicon atoms (Si) (100×(Si)/((Si)+(C))) in the diamond-like carbon film is 1 to 20, and wherein an oil film is present between the contact surface and an inner circumferential surface of the first member, the oil film containing a fluorinated oil and a silicone oil.

2. The thermal fixing apparatus according to claim 1, wherein the silicon atom is contained in the diamond-like carbon film in a state where the silicon atom is bonded to the carbon atom.

3. The thermal fixing apparatus according to claim 1, wherein the first member is a fixing belt having a sleeve shape.

4. The thermal fixing apparatus according to claim 3, wherein the fixing belt includes a base having a sleeve shape, and a polyimide film which is located on a side of the inner circumferential surface of the base and constitutes the inner surface to be brought into contact with the surface layer of the pressurizing member.

5. The thermal fixing apparatus according to claim 1, wherein the pressurizing member includes the heater, and the heater comprises a heater base, a resistance heating element, and the diamond-like carbon film.

6. The thermal fixing apparatus according to claim 5, wherein the heater base contains at least one selected from the group consisting of aluminum nitride, aluminum oxide, and silicon nitride.

7. An image forming apparatus, comprising:

a thermal fixing apparatus which heats an unfixed toner image on a recording material to fix the unfixed toner image onto the recording material, the thermal fixing apparatus including:

a first member which is rotatable;

a heater which heats the first member;

a second member which is rotatable, and forms a nip portion with the first member such that a recording material can be sandwiched therebetween; and a pressurizing member which is disposed inside the first member, has a contact surface with an inner surface of the first member, and presses the first member against the second member, wherein the pressurizing member includes a surface layer constituting the contact surface, wherein the surface layer comprises a diamond-like carbon film, wherein the diamond-like carbon film contains a hydrogen atom, a carbon atom, and a silicon atom, wherein a proportion of a number of hydrogen atoms (H) to a sum of the number of the hydrogen atoms (H) and a number of carbon atoms (C) (100×(H)/((H)+(C))) in the diamond-like carbon film is 5 or less, wherein a proportion of a number of silicon atoms (Si) to a sum of the number of the carbon atoms (C) and the number of the silicon atoms (Si) (100×(Si)/((Si)+(C))) in the diamond-like carbon film is 1 to 20, and wherein an oil film is present between the contact surface and an inner circumferential surface of the first member, the oil film containing a fluorinated oil and a silicone oil.

* * * * *